US007128100B2

(12) United States Patent
Monti

(10) Patent No.: US 7,128,100 B2
(45) Date of Patent: Oct. 31, 2006

(54) APPARATUS FOR FEEDING ARTICLES TO A BLISTER BAND

(75) Inventor: Guiseppe Monti, Pianoro (IT)

(73) Assignee: Marchesini Group S.p.A., Pianoro (IT)

( * ) Notice: Subject to any disclaimer, the term of this patent is extended or adjusted under 35 U.S.C. 154(b) by 0 days.

(21) Appl. No.: 11/108,984

(22) Filed: Apr. 19, 2005

(65) Prior Publication Data

US 2005/0230001 A1 Oct. 20, 2005

(30) Foreign Application Priority Data

Apr. 19, 2004 (IT) ..... BO2004A0224

(51) Int. Cl.
*B65B 1/04* (2006.01)

(52) U.S. Cl. ..... 141/74; 141/2; 141/67; 53/246; 53/247; 53/250; 414/300

(58) Field of Classification Search ..... 141/2, 141/18, 67, 71–82; 53/235, 244, 246–250; 414/288, 293–303
See application file for complete search history.

(56) References Cited

U.S. PATENT DOCUMENTS 6,510,676 B1 1/2003 Gauthier
6,648,575 B1 * 11/2003 Baroncini ..... 414/300
7,007,821 B1 * 3/2006 Aylward ..... 221/289
2002/0136619 A1 9/2002 Baroncini

FOREIGN PATENT DOCUMENTS

| | | |
|---|---|---|
| DE | 3842273 | 6/1989 |
| DE | 10026331 | 2/2002 |
| EP | 1380510 | 1/2004 |
| GB | 299017 | 9/1929 |

* cited by examiner

*Primary Examiner*—Steven O. Douglas
(74) *Attorney, Agent, or Firm*—William J. Sapone; Coleman Sudol Sapone P.C.

(57) ABSTRACT

In an apparatus for feeding articles to a blister band, a box-like container, situated close to said band, is fed by a delivering device with a quantity of articles such as to allow accumulation of the articles on the surface of the band. A brush strikes and pushes the articles in a direction opposite to a forwarding direction of the band. A sensor, downstream of the brush, detects the thickness of the layer of articles on the band and interacts with the brush to maintain substantially constant the thickness of the layer of articles.

13 Claims, 2 Drawing Sheets

APPARATUS FOR FEEDING ARTICLES TO A BLISTER BAND

BACKGROUND OF THE INVENTION

The present invention relates to the technical field concerning the automatic packaging, into blister packs of various articles, in particular tablets, pills, capsules and the like, for pharmaceutical and/or alimentary use.

In particular, the invention relates to an apparatus for feeding articles to a blister band situated therebelow.

BRIEF DESCRIPTION OF THE PRIOR ART

There are known many apparatuses for filling the blisters of a blister band situated therebelow, using different techniques.

An extremely widespread apparatus includes a box-like bottomless container, which is situated directly above the blister band, and whose width does not exceed the width of the blister band.

The blister band is operated to translate, on a horizontal feeding plane, with its empty blisters facing the container.

The upper part of the container is connected to the delivery means, which feed such quantities of articles, as to allow them to accumulate on the surface of the blister band.

Consequently, the exceeding accumulated articles tend, rotating and/or rubbing, to enter the empty blisters, and thus, to translate with the band, while the exceeding articles remain suitably kept inside the container.

According to known techniques, agitating means, situated in the upstream portion of the container, counter-rotate with respect to the band forwarding direction and intercept a part of the articles and keep, downstream thereof, a prefixed thickness of the layer of articles present in bulk on the blister band.

This maximum thickness is adjusted by the operator, who acts manually on the distance between the agitating means and the blister band, on the basis of his experience and empirical data.

It is understood that the best value of the maximum thickness is strictly related to the characteristics of the articles (dimensions, geometry, roughness, etc.) and of the blister band (forwarding speed, geometry and blisters arrangement, etc.).

Therefore, the adapting of the above value as a function to the evolution of the production cycle is extremely difficult and problematic, since it influences directly the production rate and the cycle quality.

According to known techniques, blade means are situated in the downstream portion of the container for keeping the exceeding articles on the band, preventing them from hitting against the walls of the container and from possible damages.

In order to avoid the damages and/or cracking of the articles, the agitating means and the blade means usually include flexible rotating brushes and similar means.

In the area between the corresponding upstream portion and downstream portion of the container, there are means, like racks and/or grates, which facilitate the introduction of the articles into the blisters.

However, the described apparatus, which can be used also with bands operated intermittently or continuously, presents a series of problems.

In particular, the best value of the maximum thickness of the layer of articles downstream of the agitating means is determined on the basis of experimental and/or empirical data and of the operator's experience.

Moreover, during the production cycle, this value is adjusted at sight by the operator, who acts manually on the distance between the counter-rotating agitating means and the blister band.

Therefore, it is understood that the handling of this value in function of the evolution of the production cycle is extremely difficult and very problematic, especially because it influences directly the production rate and the cycle quality.

In this case, the best value of the maximum thickness of the articles downstream of the agitating means is connected directly to the relation between the quantity of articles present on the band and the quantity of articles, which actually enter the blisters.

A too big number of exceeding articles on the band, due to a possible erroneous estimation of the above optimal thickness, leads inevitably to the situation, in which the articles remain in the container for long periods of time, continuing to rotate on the blister band and rubbing against it, with high probability to become damaged, scratched, broken and to perish.

Consequently, a considerable number of powders is produced, which dirties the apparatus and can enter the blisters, resulting at worst in blocking the introduction of the articles.

SUMMARY OF THE INVENTION

The object of the present invention is to propose an apparatus for feeding articles, in particular tablets, capsules, pills and the like, to a blister band situated therebelow, said apparatus assuring the correct filling of each blister with a single product, avoiding any damage to the processed products as well as to the blister band, independently from the shape and dimensions of the articles and the relative blisters.

Another object of the present invention is to propose an apparatus which allows a reduction of the quantity of necessary exceeding articles, and which assures high reliability and versatility standards in any operation conditions, allowing a particularly rapid and easy adapting of the production rate in function of the characteristics of the packaging cycle.

A further object of the present invention is to propose an apparatus, which assures the use of blister bands obtained in any way, so as to make it possible to feed them with articles of different shapes or compositions, allowing to connect the apparatus to any type of blistering packaging machine.

The above mentioned objects are obtained, in accordance with the contents of the claims, by an apparatus for feeding articles to a blister band with a plurality of blisters for receiving articles and moved longitudinally in a forwarding direction, the apparatus including:

a bottomless box-like container having width not exceeding the width of said blister band and situated close to and above the blister band;

delivering means for supplying the upstream portion of said container, considering said forwarding direction of the band, with such a quantity of articles as to allow accumulation of the articles on the surface of the blister band;

agitating means connected to said container, downstream of said delivering means, for striking a part of the articles present on the band and push this part of articles in a direction opposite to the forwarding direction, sensor means for detecting, downstream of said agitating means, thickness of a layer of articles present on the band, and interacting with at least said agitating means to maintain a substantially constant, at a prefixed value, the above thickness of the layer of articles detected by the sensor means.

BRIEF DESCRIPTION OF THE DRAWINGS

The characteristic features of the invention will be pointed out in the following description of some preferred but not exclusive embodiments, with reference to the enclosed figures, in which.

DESCRIPTION OF THE PREFERRED EMBODIMENTS

Figure 1:
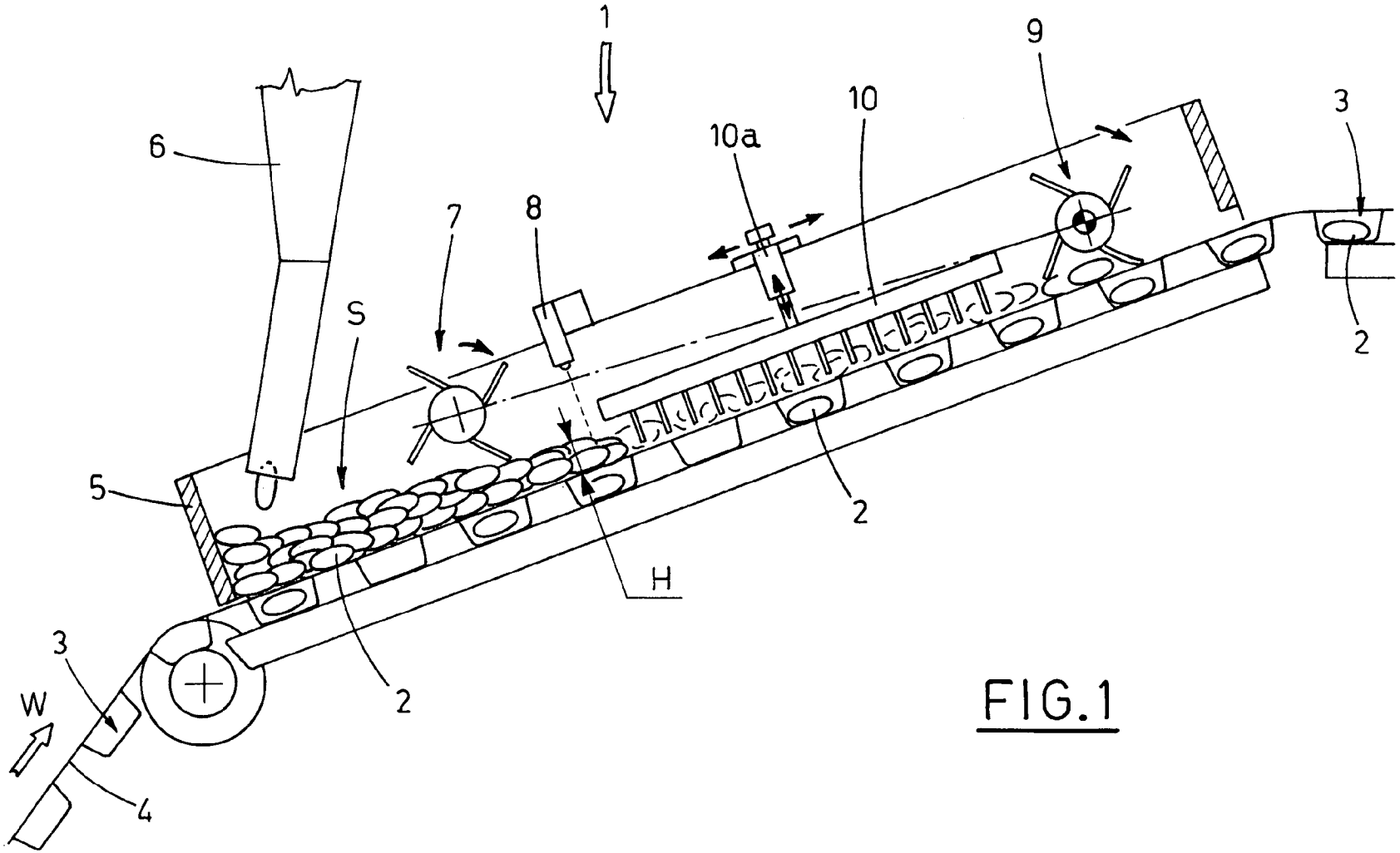
FIG. 1 is a schematic, lateral view of the proposed apparatus in a preferred embodiment.

With reference to the above Figures, the general reference numeral 4 indicates a blister band moved by conveying means of known type (not shown) in a forwarding direction W.

The blister band 4 includes a continuous sheet, usually of thermo-formable material, having a plurality of longitudinal rows of blisters 3, each of which receives a single article 2, in particular one tablet, capsule, pill or the like.

The blisters 3 are arranged in a plurality of longitudinal rows, oriented parallel to the forwarding direction W of the band 4.

The number of rows depends on the width of the band 4 and the dimension of the blisters 3.

The proposed apparatus 1 for feeding articles 2 to the blister band 4 situated below includes, according to known technique: a box-like container 5, whose transversal dimensions do not exceed the dimensions of the band 4 and which has an open bottom, situated close to the band 4, whose blisters 3 face the container 3; a hopper 6, containing articles 2 in bulk and feeding the upstream portion of the container 5 with such a quantity of articles 2, as to allow them to accumulate on the surface of the blister band 4; first rotating means 7, situated downstream of the hopper 6, preferably of brush type, counter-rotating with respect to the forwarding direction W of the band 4 and intercepting the articles 2 and pushing the latter in a direction opposite to the forwarding direction W.

The apparatus 1 proposed by the present invention includes advantageously sensor means 8 for measuring, downstream of the first rotating brush 7, the thickness H of the layer S of exceeding articles 2 present on the band 4 and for interacting with the first rotating brush 7, so as to maintain substantially constant the prefixed value of the thickness H of the layer S of articles 2.

For this purpose, actuating means, subjected to the sensor means 8, operate the axis of the first rotating brush 7 to move close to and/or far from the band 4.

Obviously, the relative positioning, upstream and downstream, is always valued with respect to the forwarding direction W of the band 4.

According to a preferred embodiment, the open bottom of the container 5, positioned close to the blister band 4, is oriented along a plane inclined downwards with respect to the forwarding direction W of the band 4.

With the upstream portion of the container 5 situated at a lower level with respect to the corresponding downstream portion, the articles 2 present on the band 4 are subjected to the combined action of the movement of the band 4 in the forwarding direction W and of the gravity, which tends to make the articles go back.

Suitable actuating means of known type (not shown) change the inclination of the open bottom of the container 5 and of the blister band 4, situated close thereto.

According to another embodiment, blade means 9, situated downstream with respect to the first rotating brush 7, intercept the articles 2, still present on the band 4, and push them in a direction opposite to the forwarding direction W of the band 4.

For example, the blade means 9 include second rotating means, of brush type, e.g. with a fixed axis, counter-rotating with respect to the forwarding direction W of the band 4 and acting close thereto.

The proposed apparatus 1 has also distributing means 10, which advantageously has a rack shape, and is interposed between the first rotating brush 7 and the second rotating brush 9, to facilitate the introduction of the articles 2 present on the band 4 into the relative blisters 3.

The rack means 10 include means 10*a* for adjusting the relative configuration of the rack means 10 with respect to the band 4.

According to further embodiments, the thickness H of the layer S of articles 2 is maintained substantially constant at a prefixed value by the interaction of the sensor means 8 with the hopper 6, in relation to the flow of articles 2 delivered to the container 5, and possibly with the actuating means changing the inclination of the open bottom of the container 5 and of the blister band 4.

Figure 2:
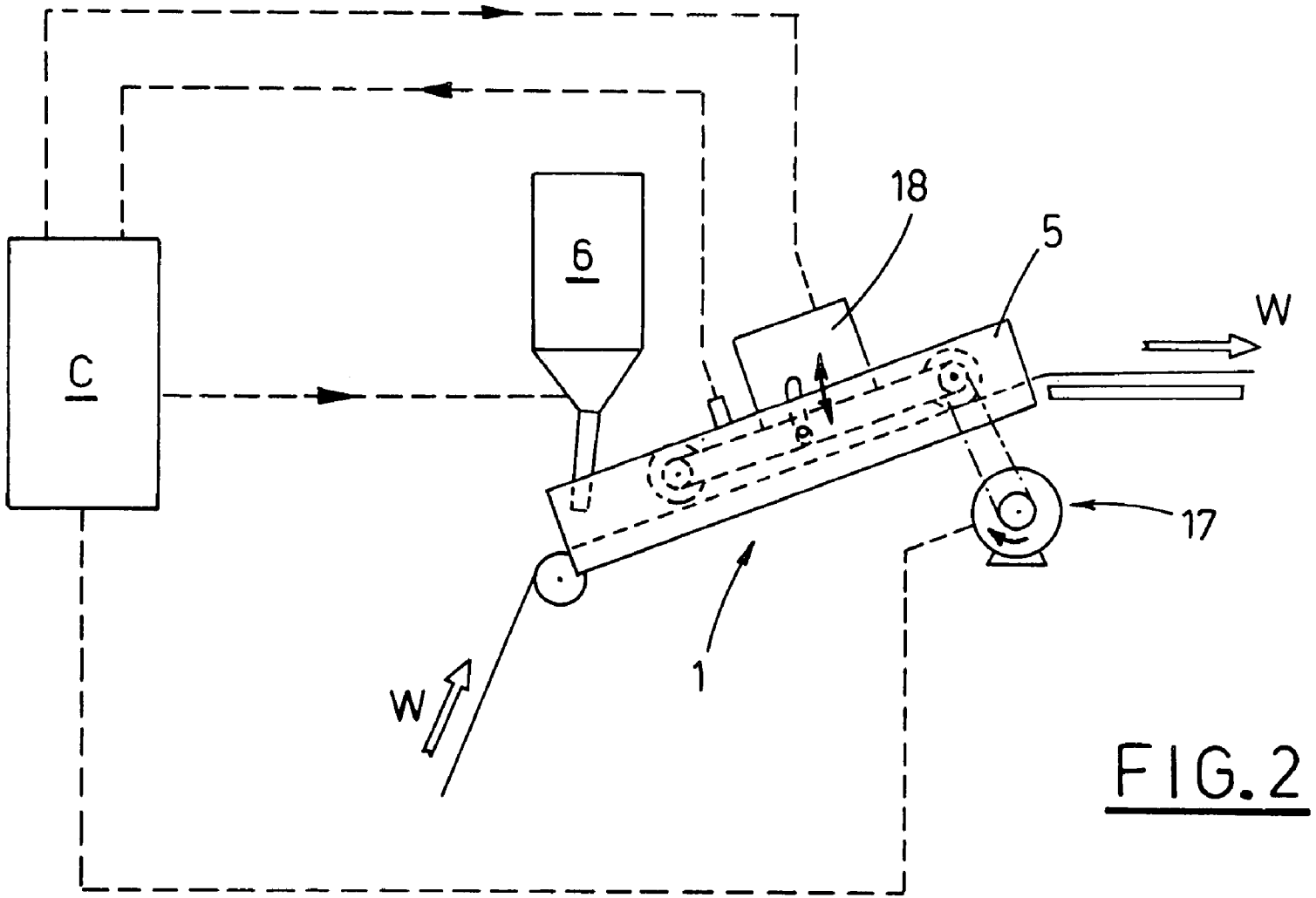
FIG. 2 is a synthetic scheme, in lower scale, of the working principle of the apparatus proposed by the invention.

FIG. 2 shows synthetically a scheme of the working principle of the apparatus 1 proposed by the invention.

There is a central control unit C which interacts with:

a) the hopper 6, for controlling the flow of articles 2 delivered to the container 5;

b) sensor means 8, which detect the thickness H of the layer S of articles 2 downstream of the first rotating brush 7;

c) actuating means 17, which operate the rotating brushes 7, 9 with the same angular speed, by a known system of transmission belts;

d) control means 18, which adjust the distance between the first rotating brush 7 and the band 4.

In particular, the container 5 is hinged to the fixed rotation axis of the second rotation brush 9 and carries the axis of the first rotating brush 7.

In this way, as a result of the signals coming from the control unit C, the container 5 is set to rotate with respect to the axis of the second rotation brush 9, suitably guided by a pin-slot group, so as to change the distance between the axis of the first rotating brush 7 and the band 4.

The control unit C is connected, in known way, to a visualization display and to a programming keyboard accessible to the operator.

Now the operation of the proposed apparatus 1 will be described with reference to a prefixed value of the desired thickness H of the layer S of articles 2, defined in relation to the characteristics of the band 4 and/or the articles 2.

During their releasing from the hopper 6, the articles 2 tend to accumulate in the upstream portion of the container 5, facilitated by the inclination of the band 4.

The articles 2, which do not enter directly the blisters 3 in the upstream portion of the container 5, are moved in the forwarding direction W of the band 4, against the gravity, to which they are subjected due to the inclination of the band.

A part of the articles 2 is intercepted by the first rotating brush 7, which pushes them backwards, and another part transits beyond the first one, toward the downstream portion of the container 5.

Downstream of the first rotating brush 7, the sensor means 8 detects the thickness H of the layer S of transiting articles 2.

In function to the above measurements, the control unit C operates, if necessary, the first rotating brush 7 to move close to or far from the band, so as to maintain substantially constant the thickness measured by the sensor means 8 with respect to the value prefixed and set by the operator through the keyboard.

The articles 2 which go beyond the first rotating brush 7 tend to engage, with high probability, the still empty blisters 3.

The articles 2, which do not enter the blisters 3, are pushed backwards by the second rotation brush 9, acting close to the band 4.

Moreover, the second rotation brush 9 removes the articles 2, which entered blisters 3 already occupied by another article 2.

The gravity, to which the articles 2 are subjected in the downstream portion of the container 5, allows them to remain on the band for a longer time before being intercepted by the second rotation brush 9.

Moreover, in the last case, the action of the second rotation brush 9 on the articles 2 is facilitated, thus softer and less sharp.

It is easily understood from the above description, how to obtain correct filling of the blisters 3 reducing strongly the production of powders.

The proposed apparatus for feeding articles, in particular tablets, capsules, pills and the like, to a blister band situated below, assures the correct filling of each blister with a single article, avoiding any damage to either the articles being processed, or to the blister band, independently from the characteristics of the articles and of the relative blisters.

The possibility to maintain the thickness of the layer of articles substantially constant downstream of the agitating means, due to the retroaction performed by the sensor means, allows to reduce the quantity of exceeding articles necessary for a correct filling of blisters.

In particular, the sensor means can advantageously interact with the actuators, which control the positioning of the first rotating brush, and possibly with the actuators, which handle the inclination of the band, as well as of the hopper.

It is understood that the proposed apparatus assures the use of any blister band, which makes it possible to feed articles having different shape or composition, and allows to connect it with any type of blister packaging machine.

It is understood that the proposed invention has been described, with reference to the enclosed figures, as a mere, not limiting example. Therefore, it is obvious that any changes or variants applied thereto remain within the protective scope defined by the following claims.

What is claimed is:

1. An apparatus for feeding articles to a blister band with a plurality of blisters for receiving articles and moved longitudinally in a forwarding direction, the apparatus including:

a bottomless box-like container having width not exceeding the width of said blister band and situated close to and above the blister band;

delivering means for supplying the upstream portion of said container, considering said forwarding direction of the band, with a quantity of articles such as to accumulate the articles on the surface of the blister band;

agitating means connected to said container, downstream of said delivering means, for striking a part of the articles present on the band and push this part of articles in a direction opposite to the forwarding direction, sensor means for detecting, downstream of said agitating means, thickness of a layer of articles present on the band, and interacting with at least said agitating means to maintain a substantially constant, at a prefixed value, the above thickness of the layer of articles detected by the sensor means.

2. An apparatus as claimed in claim 1, wherein said container facing said blister band is inclined.

3. An apparatus as claimed in claim 2, wherein said container is inclined upwards with respect to the forwarding direction of the blister band, with the upstream portion of said container being situated at a lower level with respect to the corresponding downstream portion.

4. An apparatus as claimed in claim 3, further including actuating means for changing the inclination of the blister band and of the container situated close thereto.

5. An apparatus as claimed in claim 1, further including blade means situated downstream with respect to said agitating means for intercepting and pushing articles in a direction opposite to the forwarding direction of the band.

6. An apparatus as claimed in claim 5, further including distributing means, interposed between said agitating means and said blade means for facilitating the introduction of the articles present on the band into the blisters.

7. An apparatus as claimed in claim 6, further including means for adjusting the configuration of said distributing means with respect to the band.

8. An apparatus, as claimed in claim 1, wherein said agitating means include first rotating brush means counter-rotating with respect to the forwarding direction of the band, situated close to the latter.

9. An apparatus as claimed in claim 5, wherein said blade means include second rotating brush means counter-rotating with respect to the forwarding direction and acting close to the blister band.

10. An apparatus as claimed in claim 8, further including actuating means, subjected to said sensor means and operating the axis of said first rotating means to move close to and/or far from the band.

11. An apparatus as claimed in claim 6, wherein said blade means include second rotating brush means counter-rotating with respect to the forwarding direction and acting close to the blister band.

12. An apparatus as claimed in claim 11, wherein the axis of said second rotating means is fixed with respect to the blister band.

13. An apparatus as claimed in claim 1, wherein said sensor means interact with said delivering means to maintain substantially constant the above thickness of the layer of articles.

* * * * *